US012779622B2

(12) United States Patent
Osterheld et al.

(10) Patent No.: US 12,779,622 B2
(45) Date of Patent: Nov. 3, 2026

(54) ACOUSTIC MONITORING OF CONDITIONER DURING POLISHING

(71) Applicant: Applied Materials, Inc., Santa Clara, CA (US)

(72) Inventors: Thomas H. Osterheld, Mountain View, CA (US); Benjamin Cherian, San Jose, CA (US); Jun Qian, Sunnyvale, CA (US); Haoquan Fang, Sunnyvale, CA (US); Nicholas A. Wiswell, Sunnyvale, CA (US); Sohrab Pourmand, San Jose, CA (US); Jeonghoon Oh, Saratoga, CA (US); Brian J. Brown, Palo Alto, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1057 days.

(21) Appl. No.: 17/952,059

(22) Filed: Sep. 23, 2022

(65) Prior Publication Data

US 2023/0390891 A1 Dec. 7, 2023

Related U.S. Application Data

(60) Provisional application No. 63/349,573, filed on Jun. 6, 2022.

(51) Int. Cl.
*B24B 49/00* (2012.01)
*B24B 37/005* (2012.01)
(Continued)

(52) U.S. Cl.
CPC ..... *B24B 49/003* (2013.01); *B24B 37/005* (2013.01); *B24B 49/186* (2013.01); *B24B 53/017* (2013.01)

(58) Field of Classification Search
CPC ... B24B 37/005; B24B 49/003; B24B 49/186; B24B 53/017
See application file for complete search history.

(56) References Cited

U.S. PATENT DOCUMENTS 5,240,552 A 8/1993 Yu et al.
6,159,073 A 12/2000 Wiswesser et al.
(Continued)

FOREIGN PATENT DOCUMENTS

CN 106956216 8/2019
CN 111347341 6/2020
(Continued)

OTHER PUBLICATIONS

International Search Report and Written Opinion in International Appln. No. PCT/US2022/076967, mailed on Mar. 2, 2023, 11 pages.
(Continued)

*Primary Examiner* — Michael Leslie
(74) *Attorney, Agent, or Firm* — Fish & Richardson P.C.

(57) ABSTRACT

A chemical mechanical polishing apparatus includes a platen to support a polishing pad, a conditioner head to hold a conditioner disk in contact with the polishing pad, a motor to generate relative motion between the polishing pad and the conditioner disk so as to condition the polishing pad, an in-situ acoustic monitoring system having an acoustic sensor to receive acoustic signals from the conditioner disk, and a controller configured to analyze a signal from the acoustic sensor and determine a characteristic of the conditioner disk or conditioner head based on the signal.

18 Claims, 4 Drawing Sheets

(51) Int. Cl.
*B24B 49/18* (2006.01)
*B24B 53/017* (2012.01)

(56) References Cited

U.S. PATENT DOCUMENTS

| | | | | |
|---|---|---|---|---|
| 6,296,548 | B1 | 10/2001 | Wiswesser et al. | |
| 6,488,569 | B1 | 12/2002 | Wang et al. | |
| 6,494,766 | B1 | 12/2002 | Wiswesser et al. | |
| 6,586,337 | B2 | 7/2003 | Parikh | |
| 6,910,942 | B1 | 6/2005 | Dornfeld et al. | |
| 7,150,675 | B2 * | 12/2006 | Kramer | B24B 49/10 451/8 |
| 7,163,435 | B2 | 1/2007 | Lim et al. | |
| 8,485,862 | B2 | 7/2013 | Swedek et al. | |
| 9,878,421 | B2 * | 1/2018 | Yavelberg | B24B 49/16 |
| 11,504,821 | B2 | 11/2022 | Dhandapani et al. | |
| 11,731,232 | B2 * | 8/2023 | Chen | B24B 37/005 451/5 |
| 12,172,262 | B2 * | 12/2024 | Chen | B24B 37/005 |
| 12,403,561 | B2 * | 9/2025 | Xu | B24B 49/105 |
| 12,459,075 | B2 * | 11/2025 | Okada | H01L 21/67253 |
| 12,491,603 | B2 * | 12/2025 | Wiswell | B24B 37/013 |
| 2003/0045009 | A1 * | 3/2003 | Tanaka | H01L 22/20 257/E21.525 |
| 2003/0049993 | A1 | 3/2003 | Fujii | |
| 2003/0087586 | A1 | 5/2003 | Kaushal et al. | |
| 2004/0242122 | A1 | 12/2004 | Kramer et al. | |
| 2006/0172662 | A1 | 8/2006 | Lim et al. | |
| 2007/0042682 | A1 | 2/2007 | Saikin | |
| 2007/0218806 | A1 | 9/2007 | Kistler | |
| 2011/0313558 | A1 | 12/2011 | Lehman et al. | |
| 2014/0329439 | A1 | 11/2014 | Chew et al. | |
| 2016/0013085 | A1 | 1/2016 | Chew et al. | |
| 2016/0256978 | A1 | 9/2016 | Tang et al. | |
| 2018/0071889 | A1 * | 3/2018 | Huang | G08C 17/02 |
| 2019/0047112 | A1 | 2/2019 | Fu et al. | |
| 2019/0160625 | A1 | 5/2019 | Hu et al. | |
| 2019/0283204 | A1 | 9/2019 | Swedek et al. | |
| 2019/0283209 | A1 | 9/2019 | Osterheld et al. | |
| 2020/0130130 | A1 * | 4/2020 | Chen | B24B 37/005 |
| 2020/0135517 | A1 | 4/2020 | Fung et al. | |
| 2022/0093405 | A1 | 3/2022 | Shin et al. | |
| 2022/0281057 | A1 | 9/2022 | Wiswell et al. | |
| 2022/0281058 | A1 | 9/2022 | Wiswell et al. | |
| 2023/0009048 | A1 | 1/2023 | Wiswell et al. | |
| 2023/0009737 | A1 | 1/2023 | Wiswell et al. | |

FOREIGN PATENT DOCUMENTS

| | | | |
|---|---|---|---|
| CN | 113059480 | A | 7/2021 |
| CN | 114536220 | A | 5/2022 |
| JP | 2003-086551 | | 3/2003 |
| JP | 2003-236749 | | 8/2003 |
| JP | 2007-529111 | A | 10/2007 |
| JP | 2010-023134 | | 2/2010 |
| JP | 5533666 | | 6/2014 |
| JP | 2015-523223 | A | 8/2015 |
| KR | 10-2004-0083608 | | 10/2004 |
| KR | 10-2012-0134472 | | 12/2012 |
| KR | 10-2020-0043216 | | 4/2020 |
| TW | 200301178 | A | 7/2003 |
| TW | 201930008 | | 8/2019 |
| WO | WO 2002/038336 | | 5/2002 |

OTHER PUBLICATIONS

Office Action in Taiwanese Appln. No. 111136474, dated Jan. 5, 2024, 13 pages (with English summary and search report).
Office Action in Japanese Appln. No. 2024-571205, mailed on Oct. 21, 2025, 11 pages (with English translation).
Office Action in Taiwanese Appln. No. 114109065, mailed on Jul. 2, 2025, 11 pages (with English summary).
Office Action in Japanese Appln. No. 2024-571205, mailed on May 19, 2026, 11 pages (with English translation).

* cited by examiner

ACOUSTIC MONITORING OF CONDITIONER DURING POLISHING

CROSS-REFERENCE TO RELATED APPLICATIONS

This application claims the benefit of priority to U.S. Application No. 63/349,573, filed on Jun. 6, 2022, the contents of which are hereby incorporated by reference.

TECHNICAL FIELD

The disclosure relates to chemical mechanical polishing, and more specifically to acoustic monitoring during chemical mechanical polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. For example, a conductive filler layer can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non-planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

When the polisher is in operation, the pad is subject to compression, shear and friction producing heat and wear. Slurry and abraded material from the wafer and pad are pressed into the pores of the pad material and the material itself becomes matted and even partially fused. These effects, sometimes referred to as "glazing," reduce the pad's roughness and ability to apply fresh slurry to the substrate. It is, therefore, desirable to condition the pad by removing trapped slurry, and unmatting, re-expanding or re-roughening the pad material.

The polishing system typically includes a conditioner system to condition the polishing pad. Conditioning of the polishing pad maintains the polishing surface in a consistent roughness to ensure uniform polishing conditions from wafer-to-wafer. A conventional conditioner system has a conditioner head which holds a conditioner disk with an abrasive lower surface, e.g., with diamond particles, that is placed into contact with the polishing pad. Contact and motion of the abrasive surface against the polishing pad roughens the polishing surface. However, the conditioner disk itself is subject to wear, and periodically needs to be replaced.

SUMMARY

In one aspect, a chemical mechanical polishing apparatus includes a platen to support a polishing pad, a conditioner head to hold a conditioner disk in contact with the polishing pad, a motor to generate relative motion between the polishing pad and the conditioner disk so as to condition the polishing pad, an in-situ acoustic monitoring system having an acoustic sensor to receive acoustic signals from the conditioner disk, and a controller configured to analyze a signal from the acoustic sensor and determine a characteristic of the conditioner disk or conditioner head based on the signal.

One or more of the following possible advantages may be realized.

Wear of a conditioner disk can be monitored in-situ, and the end-of-life of a conditioner disk can be detected in-situ and more reliably. An alert can be generated to trigger replacement of the conditioner disk if the end-of-life of the conditioner is detected. A risk of defects or scratching of the substrate can be reduced. The useful lifetime of conditioner disks can be improved, and downtime for replacement of the conditioner disk can be reduced, thus improving cost of ownership. Other abnormalities associated with the conditioner can be detected, and an alert can be generated to trigger corrective action. For example, an improper installation of a conditioner disk or incorrect conditioning downforce can be detected.

The details of one or more embodiments are set forth in the accompanying drawings and the description below. Other features and advantages will be apparent from the description and drawings, and from the claims.

DESCRIPTION OF DRAWINGS

In the figures, like references indicate like elements.

DETAILED DESCRIPTION

A chemical mechanical polishing process can include a pad conditioning step in which a conditioner disk, e.g., a disk coated with abrasive diamond particles, is pressed against the rotating polishing pad to condition and texture the polishing pad surface. However, the friction of the pad against the abrasive particles of the conditioner disk and/or the chemistry of the polishing liquid can gradually wear out the conditioner disk. For example, abrasive particles can become blunted, reducing the wear rate, or abrasive particles could come loose from the conditioner disk, resulting in scratching and defects on the substrate. Consequently, the conditioning disk periodically needs to be replaced. However, due to simple manufacturing variation, conditioning disk may not all have the same lifetime.

One approach is to simply replace the conditioning disk after a set interval, e.g., after polishing of a preset number of substrates or after a preset time of use. However, this carries the risk of both underuse of the conditioning disk, i.e., replacing a disk that still has useful life, and overuse with the risk of damage to the substrate. Another approach is to monitor the wear of the polishing pad; a change in wear rate can indicate a problem with the conditioner disk. However, this is an indirect indication; the conditioner disk might be subject to wear and risk of detachment of abrasive particles without a change in wear rate.

Monitoring of acoustic signals from the conditioner disk may address these issues and may be a more reliable technique for detecting that a conditioner disk needs to be replaced. Even without monitoring of conditioner disk lifetime, acoustic monitoring can provide indications of other abnormalities, permitting corrective action to be taken by the operator of the polishing system.

Figure 1:
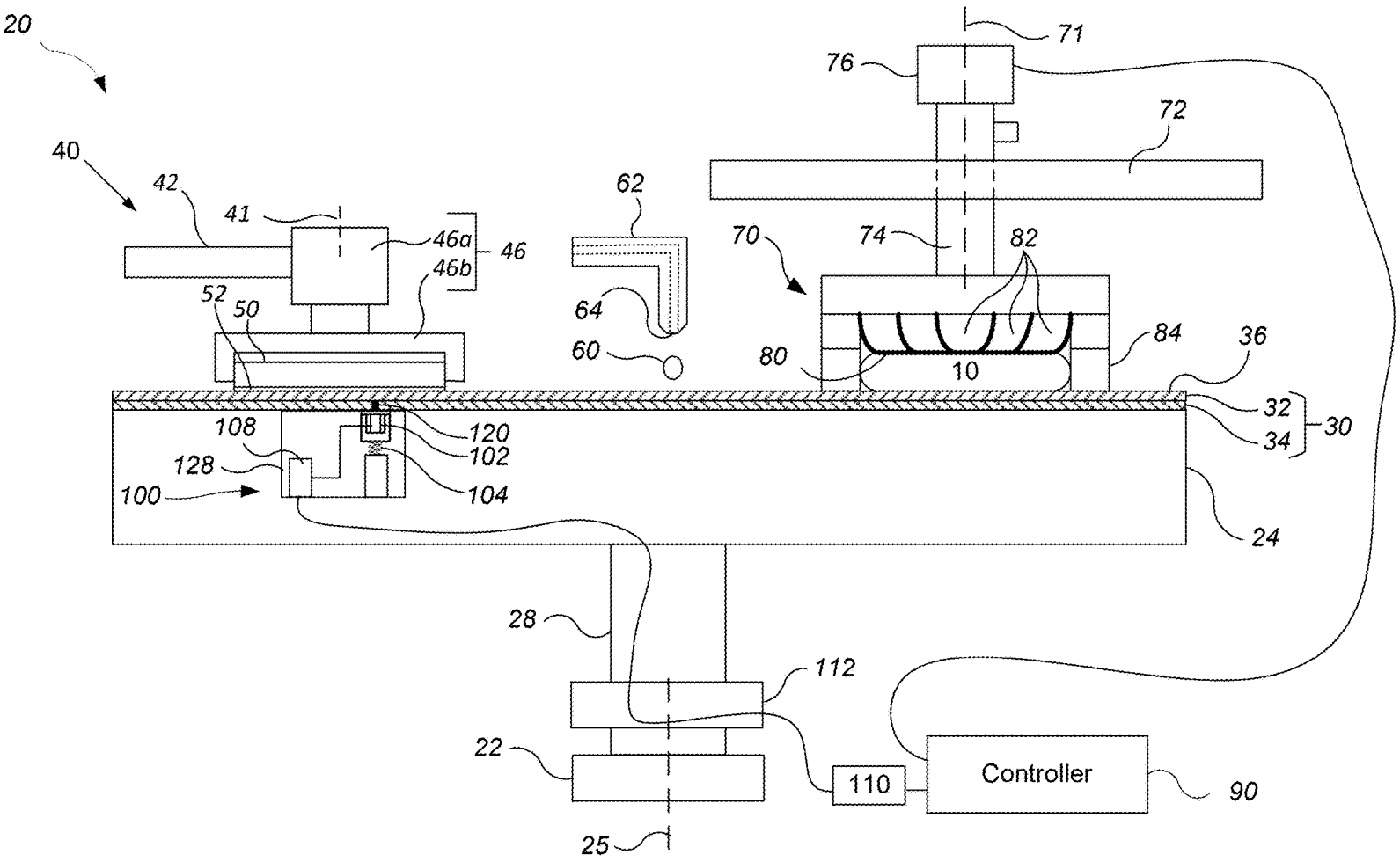
FIG. 1 is a schematic side view of a polishing system including a conditioner and an in-situ acoustic monitoring system.
Figure 2A:
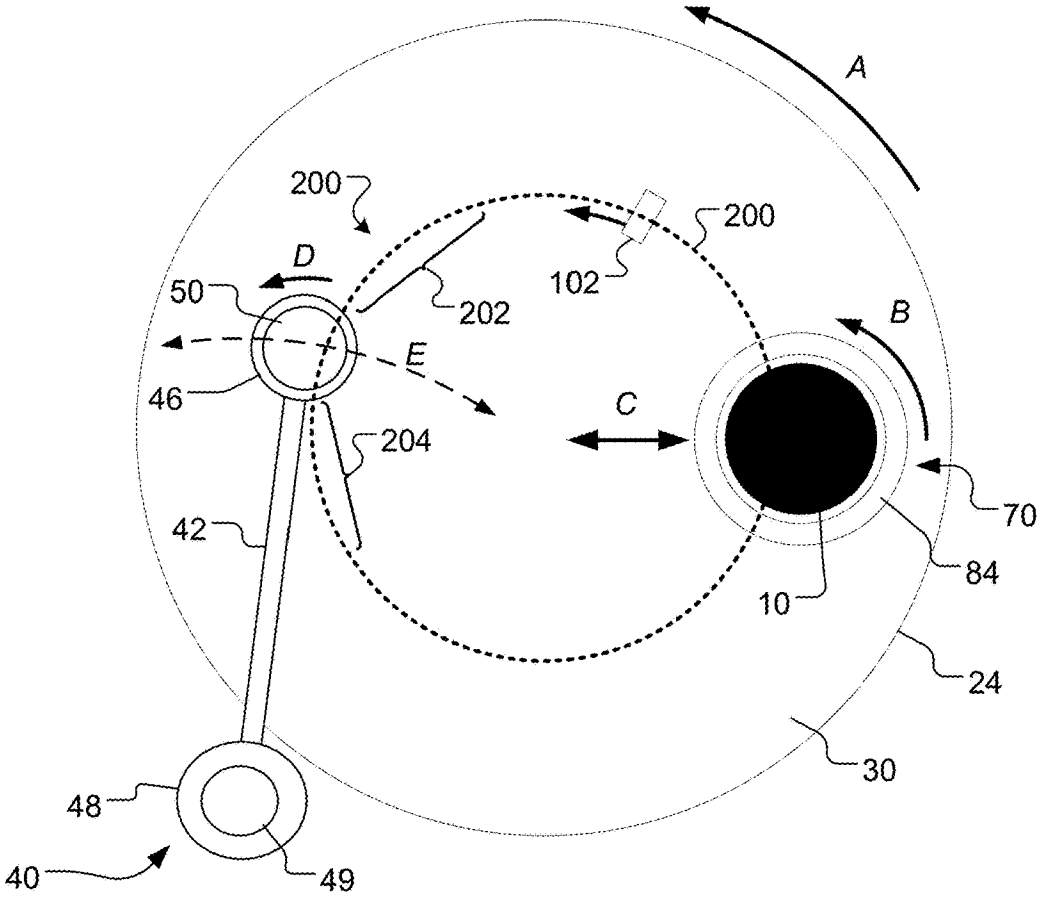
FIG. 2A is a schematic top view of a polishing system.

As shown in FIGS. 1 and 2A, a chemical mechanical polishing system 20 includes a rotatable platen 24 on which a polishing pad 30 is situated. The platen 24 is operable to rotate (see arrow A in FIG. 2A) about an axis 25. For example, a motor 22 can turn a drive shaft 28 to rotate the platen 24. The polishing pad 30 can be a two-layer polishing pad with an outer polishing layer 32 having a polishing surface 36 and a softer backing layer 34.

The polishing system 20 includes a supply port 64, e.g., at the end of a slurry supply arm 62, to dispense a polishing liquid 60, such as an abrasive slurry, onto the polishing pad 30. In some implementations, the polishing system 20 includes a wiper blade or body to evenly distribute the polishing liquid 60 across the polishing pad 30.

A carrier head 70 is suspended from a support structure 72, e.g., a carousel or a track, and is connected by a drive shaft 74 to a carrier head rotation motor 76 so that the carrier head can rotate about an axis 71 (see arrow B in FIG. 2A). Optionally, the carrier head 70 can oscillate laterally (see arrow C in FIG. 2A), e.g., on sliders on the carousel or track 72; or by rotational oscillation of the carousel itself. In operation, the platen is rotated about its central axis 25, and the carrier head is rotated about its central axis 71 and translated laterally across the top surface of the polishing pad 30. The carrier head 70 can include a flexible membrane 80 having a substrate mounting surface to contact the back side of the substrate 10, and a plurality of pressurizable chambers 82 to apply different pressures to different zones, e.g., different radial zones, on the substrate 10. Although three chambers are illustrated in FIG. 1 for ease of illustration, there could be one or two chambers, or four or more chambers, e.g., five chambers. The carrier head 70 can also include a retaining ring 84 to hold the substrate below the membrane 80.

A controller 90, such as a programmable computer, is connected to the motors 22, 76 to control the rotation rate of the platen 24 and carrier head 70. For example, each motor can include an encoder that measures the rotation rate of the associated drive shaft.

The polishing system 20 also includes a pad conditioner 40 with a conditioner disk 50 to maintain the surface roughness of the polishing pad 30. A bottom surface of the conditioner disk 50 includes one or more abrasive regions 52 that contact the polishing surface 36 during the conditioning process. The abrasive regions can be provided by abrasive diamond particles that are secured to a lower surface of a backing plate. The backing plate is typically a metal, such as stainless steel, although other materials such as a ceramic are possible. In some implementations, abrasive particles of other compositions, e.g., silicon carbide, are used instead of or in addition to diamond particles.

During conditioning, the abrasive regions move relative to the surface of the polishing pad 30, thereby abrading and retexturizing the polishing surface 36. For example, both the polishing pad 30 and the conditioning disk 50 can rotate (see arrows A and D in FIG. 2A).

The conditioner disk 50 can be held by a conditioner head 46 at the end of an arm 42. The arm 42 and conditioner head 46 are supported by a base 48. The arm 42 can swing so as to sweep the conditioner head 46 and conditioner disk 50 laterally across the polishing pad 30 (see arrow E in FIG. 2A). For example, the base 48 can be driven by a motor 49 to pivot about a vertical axis and thereby sweep the arm 42 and the conditioner head 46 laterally over the platen 24 and polishing pad 30.

The conditioner head 46 includes mechanisms to attach the conditioner disk 50 to the conditioner head 46 (such as mechanical attachment systems, e.g., bolts or screws, or magnetic attachment systems) and mechanisms to rotate the conditioner disk 50 around an axis 41 (such as drive belts through the arm or rotors inside the conditioner head). In addition, the pad conditioner 40 can also include mechanisms to regulate the pressure between the conditioner disk 50 and the polishing pad 30 (such as pneumatic or mechanical actuators inside the conditioning head or the base) and/or to change the vertical position of the conditioner disk 50 relative to the polishing pad 30. For example, the conditioner head 46 can include an upper portion 46*a*, a lower portion 46*b* that holds the conditioner disk 50, and an actuator to adjust the vertical position of the lower portion 46*b* relative to the upper portion 46*a* or to adjust the pressure of the conditioner disk 50 on the polishing pad 30. However, these mechanisms can have many possible implementations (and are not limited to those shown in FIG. 1). As other examples, a vertical actuator can be located in the base 48 to lift and lower the arm 42, or the arm can be pivotally attached to the base 48 in a manner that permits it to swing vertically to lower and lift the conditioner head 46 from the polishing pad 30.

The polishing system 20 includes at least one in-situ acoustic monitoring system 100. The in-situ acoustic monitoring system 100 includes an acoustic sensor 102. In the implementation shown in FIGS. 1, the acoustic sensor 102 is positioned on a side of the substrate 10 farther from the polishing pad 30 and will receive acoustic signals through the polishing pad 30 from the substrate conditioner disk 50. In particular, the acoustic sensor 102 can be supported on the platen 24. For example, the acoustic sensor 102 can be positioned in a recess 128 in the platen 24. In some implementations, a top surface of the acoustic sensor 102 is coplanar with the top surface of the platen 24.

The acoustic sensor 102 is positioned on the platen 24 at a radial position (from the axis 25) such that the sensor 102 will, at least for some lateral positions of conditioner head 46, sweep below the conditioner disk 50. For example, the acoustic sensor 102 can be located at a midpoint between the edge of the platen 24 and the axis of rotation 25.

The polishing system 20 includes at least one in-situ acoustic monitoring system 100. The in-situ acoustic monitoring system 100 includes an acoustic sensor 102. In the implementation shown in FIGS. 1, the acoustic sensor 102 is positioned on a side of the substrate farther from the polishing pad 30 and will receive acoustic signals through the polishing pad from the substrate conditioner disk 50. In particular, the acoustic sensor 102 can be supported on the platen 24. For example, the acoustic sensor 102 can be positioned in a recess 28 in the platen 24. In some implementations, a top surface of the acoustic sensor 102 is coplanar with the top surface of the platen 24.

The acoustic sensor 102 is positioned on the platen 24 at a radial position (from the axis such that the sensor 102 will, at least for some lateral positions conditioner head 46, sweep below the conditioner disk 50. For example, the acoustic sensor 102 can be located at a midpoint between the edge of the platen 24 and the axis of rotation 25.

In some implementations, the portion of the polishing pad directly above the acoustic sensor 102 can include an acoustic window 120, e.g., a region having lower acoustic impedance than the surrounding polishing material. The acoustic window 120 can extend through the polishing layer 32, or the backing layer 34, or both. However, if the acoustic transmission of the polishing pad is sufficiently high, the acoustic window 120 may not be necessary.

The acoustic sensor 102 can be a contact acoustic sensor having a surface connected to (e.g., in direct contact with, or having just an adhesive layer for attachment to, or having just an acoustic gel for transmission of the acoustic signal from) a portion of the polishing pad, e.g., the polishing layer 32, or the backing layer 34, or the acoustic window 120. For example, the acoustic sensor 102 can be an electromagnetic acoustic transducer or piezoelectric acoustic transducer. A piezoelectric sensor can include a rigid contact plate, e.g., of stainless steel or the like, which is placed into contact with the body to be monitored, and a piezoelectric assembly, e.g., a piezoelectric layer sandwiched between two electrodes, on the backside of the contact plate.

In some implementations, a spring 104 is positioned to urge the acoustic sensor 102 into contact with a portion of the polishing pad 30. In some implementations, the spring 104 is a long travel spring.

The acoustic sensor 102 can be connected by circuitry 108 to a power supply and/or other signal processing electronics 110 through a rotary coupling 112, e.g., a mercury slip ring. The signal processing electronics 110 can be connected in turn to the controller 90. In some implementations, some or all of the functionality of the signal processing electronics 110 is performed by the controller 90.

In some implementations, the in-situ acoustic monitoring system 100 is a passive acoustic monitoring system. In this case, signals are monitored by the acoustic sensor 102 without generating signals from an acoustic signal generator (or the acoustic signal generator can be omitted entirely from the system). The passive acoustic signals monitored by the acoustic sensor 102 can be in 50 kHz to 1 MHz range, e.g., 200 to 400 kHz, or 200 Khz to 1 MHz.

The signal from the sensor 102 can be amplified by a built-in internal amplifier. In some implementations, the amplification gain is between 40 and 60 dB (e.g., 50 dB). The signal from the acoustic sensor 102 can then be further amplified and filtered if necessary, and digitized through an A/D port to a high speed data acquisition board, e.g., in the electronics 108 or 110. Data from the acoustic sensor 102 can be recorded at a range of from 1 to 10 Mhz, e.g., 1-3 MHz or 6-8 Mz. In implementations in which the acoustic sensor 162 is a passive acoustic sensor, a frequency range from 100 kHz to 2 MHz can be monitored, such as 500 kHz to 1 MHz (e.g., 750 kHz).

A position sensor, e.g., an optical interrupter connected to the rim of the platen or a rotary encoder, can be used to sense the angular position of the platen 24. This permits only portions of the signal measured when the sensor 102 is in proximity to the conditioner disk 50, e.g., when the sensor 102 is below the conditioner disk 50, to be used as indicative of the conditioner disk condition in subsequent signal processing.

Referring to FIG. 2A, due to motion of the platen 24 (shown by arrow A), the acoustic sensor 102 sweeps in a path 200 that travels below the conditioner disk 50. The acoustic monitoring system 100, e.g., the controller 90, can be configured to sample signals from the sensor 102 when the sensor is passing below the conditioner disk 50. For example, the controller 90 can determine the angular position of the sensor 102 based on input from a motor encoder or the platen position sensor, and compare this to a position of the conditioner head, e.g., based on conditioner sweep information. Determination of the position of a sensor relative to a substrate is discussed in U.S. Pat. No. 6,159,073 and in U.S. Pat. No. 6,296,548; equivalent techniques can be applied for a moving conditioner disk. This permits the portions of the signal received when the sensor 102 is below the conditioner disk 50 to be identified and selected.

Figure 2B:
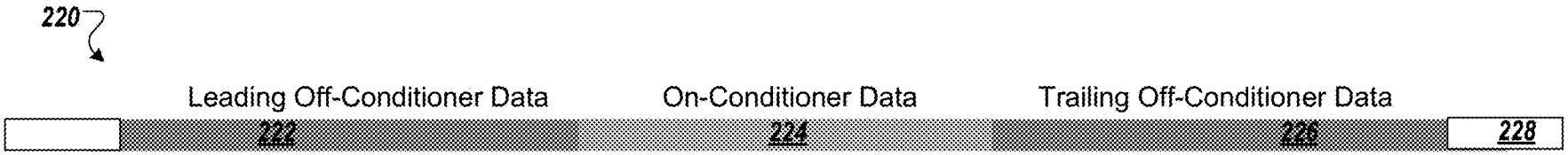
FIG. 2B is an illustration of a division of a signal from an acoustic sensor by position relative to a conditioner.

Referring to FIGS. 2A and 2B, a signal 220 from the sensor 102 can include a portion 222 corresponding to the sensor 102 being off but approaching the conditioner disk 50 (indicated by region 202 of path 200 and referred to as "leading off-conditioner data"), a portion 224 corresponding to the sensor 102 under the conditioner disk 50 (referred to as "on-conditioner data"), and a portion 222 corresponding to the sensor 102 being off and after the conditioner disk 50 (indicated by region 204 of path 200 and referred to as "trailing off-conditioner data"). The leading and trailing off conditioner data can each correspond to an arc of travel of 5-30° along the path 200 by the sensor 102.

Figure 3:
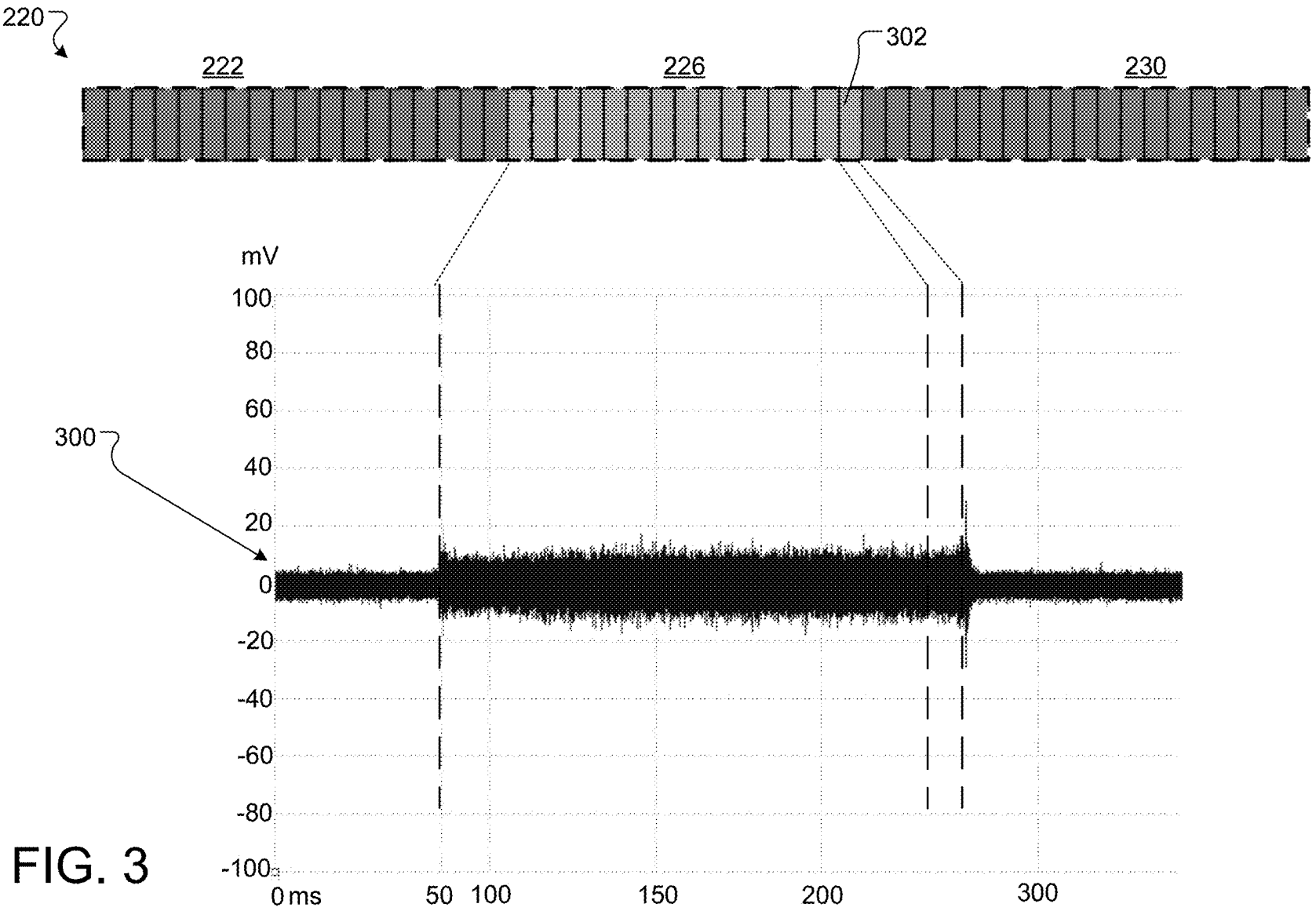
FIG. 3 is an illustration of an example acoustic signal and segments corresponding to different portions of the ring assembly or substrate.

FIG. 3 illustrates an example of acoustic signal 300. As illustrated, the signal strength can increase when the sensor 102 is located below the conditioner disk 50, i.e., for the "on-conditioner data." The acoustic monitoring system 100 can process the acoustic signal 300 and subdivide the acoustic signal 300 into segments, which can aid in subsequent signal processing.

In general, at least the on-conditioner data 226 is used for monitoring of the conditioner disk 50 discussed below. In some implementations, the leading off-conditioner data 222 and/or trailing off-conditioner data 230 is also used for monitoring of the conditioner disk 50. But in some implementations only the on-conditioner data is used. Portions of the signal not used in the conditioner disk monitoring can still be used for other monitoring purposes, such as detection of a polishing endpoint or detection of defects on the substrate 10.

Returning to FIG. 1, acoustic signals generated by the interface between the conditioner disk 50 and the polishing layer 32 of the polishing pad 30 travel through the polishing pad 110 and are received by the acoustic sensor 102. The acoustic sensor 102 transmits the received to signal processing electronics 110 which perform functions on the received acoustic signal. The electronics 110 can include, for example, a filter, an amplifier, a spectrum analyzer, a data acquisition system (DAQ), or other components for processing the received acoustic signal. In general, the electronics 110 can include a general purpose programmable computer, dedicated circuitry, or a combination thereof. In some implementations, the electronics 110 is within, e.g., implemented by, the controller 90.

The signal from the acoustic sensor 102, e.g., after amplification, preliminary filtering and digitization, can be subject to data processing, e.g., in the controller 90, for either detection of the wear state of the conditioner disk 50, and/or for detection of other abnormalities of the conditioner head 46. The controller 90 can generate an alert indicating the type of event, e.g., the alert can indicate that the conditioner disk needs to be replaced, or that a conditioner disk is not properly attached to the conditioner head, or that the pressure by the conditioner disk does not match what is expected.

In some implementations, the controller 90 is configured to monitor a change in acoustic signal strength. For example, for an active acoustic monitoring system (in which the sensor 102 emits acoustic energy), the received signal strength is compared to the emitted signal strength to generate a normalized signal, and the normalized can be monitored over time to detect changes. As another example, for an passive acoustic monitoring system, the received signal strength is compared to a measured initial signal strength, e.g., obtained when the conditioner disk is newly installed on the carrier head, to generate a normalized signal, and the normalized can be monitored over time to detect changes. Such changes can indicate a change in the conditioner disk, e.g., that the conditioner disk has been worn and needs to be replaced.

As another example, an amount of noise in the signal, e.g., a deviation, such as the rms variance, of the signal is monitored. For example, a deviation value calculated for the signal can be compared to a threshold value. If the deviation value crosses the threshold, this can indicate a change in the conditioner disk, e.g., that the conditioner disk has been worn and needs to be replaced.

In some implementations, a frequency analysis of the signal is performed. For example, frequency domain analysis can be used to determine changes in the relative power of spectral frequencies. In particular, a Fourier transform, e.g., a Fast Fourier Transform (FFT), can be performed on the signal to generate a spectrum (e.g., a power, wavelength or frequency spectrum). A particular band of power, wavelength or frequency can be monitored, and if the intensity in the band crosses a threshold value, this can indicate that the conditioner disk has been worn and needs to be replaced. Alternatively, if a location (e.g., wavelength) or bandwidth of a local maxima or minima in a selected frequency range crosses a threshold value, this can indicate a change in the conditioner disk, e.g., that that the conditioner disk has been worn and needs to be replaced.

In some implementations, a spectrum of signal can be compared to a reference spectrum. If the difference, e.g., a summed square of differences over the power, wavelength or frequency range, exceeds or falls below a threshold, this can indicate a change in the conditioner disk, e.g., that that the conditioner disk has been worn and needs to be replaced.

Determination of the appropriate characteristic of the signal to monitor and the appropriate criterion for triggering an indication of a change in the conditioner disk can be determined empirically. For example, polishing can be performed with a worn conditioning disk, e.g., a disk is known to have a low polishing pad wear rate, and the spectrum of the signal from this conditioning disk can be used as a reference spectrum. As another example, polishing can be performed with both a fresh conditioning disk and a worn conditioning disk. The spectra of the signals can be compared to empirically determine a power, wavelength or frequency band for monitoring, and whether the worn conditioner disk has higher or lower signal strength within that band. Criteria for the signal to generate an alert indicating that the conditioner disk has been worn and needs to be replaced can be derived, and the controller 90 can be configured to test whether the signal meets the criteria.

As another example, polishing can be performed with a conditioner disk that is known to be improperly installed on the conditioner head, and the spectrum of the signal from this improperly installed conditioner disk can be used as a reference spectrum. As another example, polishing can be performed with both a properly installed and an improperly installed conditioner disk. The spectra of the signals can be compared to empirically determine a power, wavelength or frequency band for monitoring, and whether the improperly installed conditioner disk has higher or lower signal strength within that band. Criteria for the signal to generate an alert indicating that the conditioner disk is not properly installed can be derived, and the controller 90 can be configured to test whether the signal meets the criteria.

As another example, polishing can be performed with a fresh conditioner disk, and the spectrum of the signal from fresh disk can be used as a reference spectrum. This can provide a "gold" signal spectrum. If the measured spectrum of another disk departs from the reference spectrum, this can indicate a problem. The controller 90 can then analyze which of the other known issues, e.g., a worn or improperly installed conditioner disk, provides the closest fit. If spectra corresponding to known problems do not fit the measured spectrum within a threshold value, the system can generate a general fault signal indicating an unknown problem.

As another example, polishing can be performed with a conditioner disk under a first load corresponding to a desired pressure set by a polishing recipe, and polishing can be performed with a conditioner disk under a different second load, e.g., a lower load. Under a lower load on the conditioner disk, there should be lower friction, and thus a lower signal from the acoustic monitoring system. The spectra of the signals can be compared to empirically determine a power, wavelength or frequency band for monitoring, and whether the friction on (and thus load applied) to the conditioning disk matches the expected value. Criteria for the signal to generate an alert indicating that the load on the conditioner disk does not match the expected load can be derived, and the controller 90 can be configured to test whether the signal meets the criteria.

In operation, an acoustic signal is collected from the in-situ acoustic monitoring system 100. The signal is monitored to detect a change in the conditioner disk or other problem related to the conditioner head. Detection of the change or problem can trigger an alert to an operator, or can automatically halt the polishing operation. The conditioner disk can be removed and replaced, or removed and reinstalled, depending on the nature of the problem.

Figure 4:
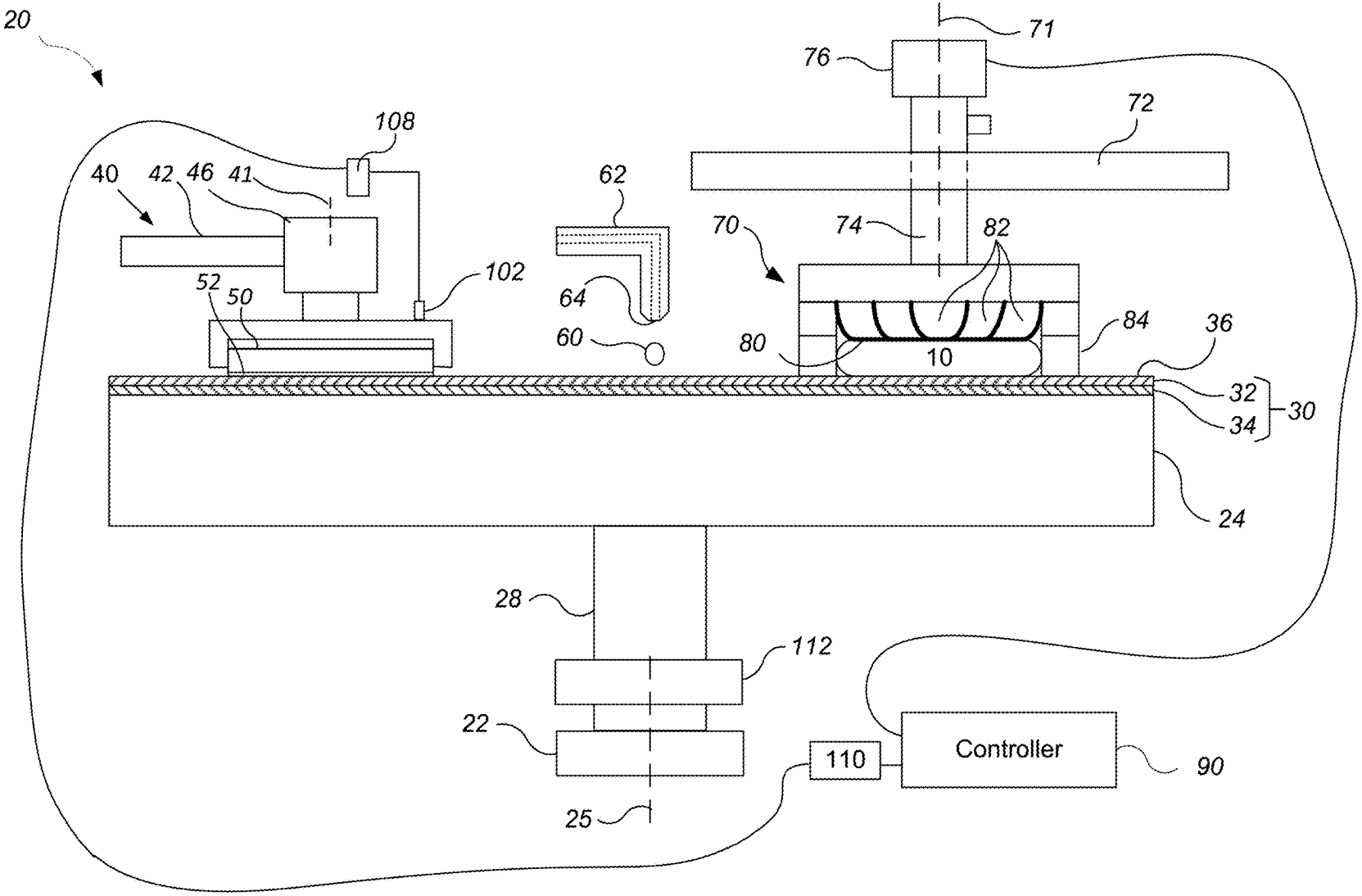
FIG. 4 is a schematic side view of a polishing system including a conditioner and another implementation of an in-situ acoustic monitoring system.

FIG. 4 illustrates another implementation of an in-situ acoustic monitoring system in which the sensor 102 is attached to the conditioner head 46 rather than supported by the platen. This simplifies signal processing, in that the controller 90 does not need to select portions of the signal that correspond to the sensor 102 passing below the conditioner disk 50. On the other hand, the positional information is lost; sensor 102 is likely to pick up acoustic signals from the entire conditioning disk 50, and does not have an off-conditioner signal to calibrate against.

The controller 90, and other control of other functional operations described in this specification, can be implemented in digital electronic circuitry, or in computer software, firmware, or hardware, or in combinations of them. The controller 90 and other functionality can be implemented using one or more non-transitory computer program products, i.e., one or more computer programs tangibly embodied in a machine readable storage device, for execution by, or to control the operation of, data processing apparatus, e.g., a programmable processor, a computer, or multiple processors or computers. The controller 90 and other functionality can be implemented using one or more programmable processors executing one or more computer programs, e.g., in a general purpose computer, or using special purpose logic circuitry, e.g., an FPGA (field programmable gate array) or an ASIC (application specific integrated circuit).

A number of embodiments of the invention have been described. Nevertheless, it will be understood that various modifications may be made. For example:

Rather than sweeping along an arcuate path, the conditioner head can be moved linearly, e.g., carried along a linear rail.

The polishing pad can be a belt driven by rollers rather a circular pad on a platen.

The polishing pad can be a fixed-abrasive pad or other material.

While this specification contains many details, these should not be construed as limitations on the scope of what may be claimed, but rather as descriptions of features specific to particular examples. Certain features that are described in this specification in the context of separate implementations can also be combined. Conversely, various features that are described in the context of a single implementation can also be implemented in multiple embodiments separately or in any suitable subcombination.

What is claimed is:

1. A chemical mechanical polishing apparatus, comprising:

a platen to support a polishing pad;

a conditioner head to hold a conditioner disk in contact with the polishing pad;

a motor to generate relative motion between the polishing pad and the conditioner disk so as to condition the polishing pad;

an in-situ acoustic monitoring system having:

an acoustic sensor housed within the platen and configured to receive acoustic signals from the conditioner disk, and a position sensor configured to determine a position of the acoustic sensor; and a controller configured to:

identify, using an output signal from the position sensor, portions of the output signal from the acoustic sensor that correspond to the acoustic sensor being positioned below the conditioner disk, analyze the portions of the output signal from the acoustic sensor, and determine a characteristic of the conditioner disk or conditioner head based on portions of the output signal.

2. The apparatus of claim 1, wherein the acoustic sensor contacts a bottom surface of the polishing pad.

3. The apparatus of claim 1, wherein the controller is configured to detect acoustic events that result from friction of the conditioner disk against the polishing pad.

4. The apparatus of claim 1, wherein the controller is configured to at least one of generate an alert, halt polishing, or change a conditioning parameter based on the determined characteristic of the conditioner disk or conditioner head.

5. The apparatus of claim 4, wherein the controller is configured to detect that the conditioner disk is sufficiently worn to need replacement.

6. The apparatus of claim 4, wherein the controller is configured to detect that the conditioner disk is improperly installed in the conditioner head.

7. The apparatus of claim 4, wherein the controller is configured to detect that a pressure of the conditioner disk on the polishing pad does not match a desired pressure.

8. The apparatus of claim 1, wherein the controller is configured to generate a measured spectrum of the output signal.

9. The apparatus of claim 8, wherein the controller is configured to compare the measured spectrum to a reference spectrum.

10. The apparatus of claim 8, wherein the controller is configured to detect a signal strength in a band in the measured spectrum and compare the signal strength to a threshold.

11. The apparatus of claim 1, wherein the position sensor is an optical interrupter.

12. The apparatus of claim 1, wherein the position sensor is a rotary encoder.

13. A method of monitoring a conditioner disk, comprising:

while the conditioner disk is conditioning a polishing pad, receiving, from the conditioner disk, acoustic signals at an acoustic sensor housed within a platen supporting the polishing pad;

determining, by a position sensor, a position of the acoustic sensor;

identifying, using an output signal from the position sensor, portions of the acoustic signals that correspond to the acoustic sensor being positioned below the conditioner disk;

using the portions of the acoustic signals that correspond to the acoustic sensor being positioned below the conditioner disk, generating an output signal from the acoustic sensor; and analyzing the output signal and determining a characteristic of the conditioner disk or conditioner head based on the output signal.

14. The method of claim 13, comprising detecting that the conditioner disk is sufficiently worn to need replacement.

15. The method of claim 13, comprising detecting that the conditioner disk is improperly installed in the conditioner head.

16. The method of claim 13, comprising detecting that a pressure of the conditioner disk on the polishing pad does not match a desired pressure.

17. The method of claim 13, wherein the position sensor is an optical interrupter.

18. The method of claim 13, wherein the position sensor is a rotary encoder.

* * * * *